United States Patent [19]

Takebe et al.

[11] 4,026,241

[45] May 31, 1977

[54] MAGNETIC BRUSH DEVELOPING DEVICE FOR USE IN ELECTROPHOTOGRAPHIC COPYING APPARATUS

[75] Inventors: Kaoru Takebe; Tetsuya Utsumi, both of Toyokawa, Japan

[73] Assignee: Minolta Camera Kabushiki Kaisha, Osaka, Japan

[22] Filed: May 23, 1975

[21] Appl. No.: 580,264

[30] Foreign Application Priority Data

June 4, 1974 Japan ..... 49-63517

[52] U.S. Cl. ..... 118/653; 118/602; 118/612; 118/658; 355/3 DD; 427/18

[51] Int. Cl.[2] ..... G03G 15/08; G03G 15/09

[58] Field of Search ..... 118/637, 602, 612, 653, 118/657, 658; 427/18; 355/3 DD; 259/104

[56] References Cited

UNITED STATES PATENTS

| | | | |
|---|---|---|---|
| 2,861,786 | 11/1958 | Madsen | 259/104 |
| 2,910,964 | 11/1959 | Stavrakis et al. | 118/637 |
| 3,145,122 | 8/1964 | Streich, Sr. | 118/637 |
| 3,635,553 | 1/1972 | Adamek et al. | 118/637 X |
| 3,638,614 | 2/1972 | Young et al. | 118/637 |
| 3,659,556 | 5/1972 | Mutschler | 118/637 |
| 3,697,050 | 10/1972 | Stanley | 118/637 X |
| 3,754,526 | 8/1973 | Caudill | 118/637 |
| 3,863,603 | 2/1975 | Buckley et al. | 118/637 |
| 3,883,240 | 5/1975 | Ito et al. | 355/3 DD |
| 3,926,517 | 12/1975 | Nagahara | 355/3 DD |
| 3,943,886 | 3/1976 | Vola et al. | 118/637 |

*Primary Examiner*—James Kee Chi
*Attorney, Agent, or Firm*—Wolder & Gross

[57] ABSTRACT

A magnetic brush developing unit for an electrophotographic reproducing apparatus, the brush element being a nonmagnetic sleeve rotating around fixed magnets, together with a first agitator providing both lateral and progressive mixing of depleted developer (with addition of toner, if necessary) as it leaves the magnetic brush via a scraper blade, a second agitator for additional mixing of the freshened developer and for conveying same to a roll with axial channels on its surface. The channels supply the freshened developer to the sleeve to form a new brush for another pass at a photoconductor having the same or another latent image on it. All adjacent rotating members turn in particular directions to assist circulation of developer and to enhance efficiency of agitation.

3 Claims, 3 Drawing Figures

MAGNETIC BRUSH DEVELOPING DEVICE FOR USE IN ELECTROPHOTOGRAPHIC COPYING APPARATUS

BACKGROUND OF THE INVENTION

1. Field of the Invention

This invention relates to a magnetic brush developing device for use in an electrophotographic reproducing apparatus.

2. Discussion of the Prior Art

In general, magnetic brush developing devices are known in which there are formed bristles of a magnetic developer at magnetic poles appearing on the outer peripheral surface of a rotatable sleeve made of nonmagnetic material, but having built-in fixed magnets. The bristles of the above-mentioned magnetic brush slidingly contact an electrostatic latent image formed on the surface of a photosensitive member located in the immediate vicinity of the aforesaid rotatable sleeve for purposes of developing the image. With this known device, the developer which forms magnetic brush bristles at the magnetic poles on the outer periphery of the sleeve is carried on the rotating sleeve into the development area, and then removed by means of a developer-scraping plate, the removed developer and fresh toner supplied in a given amount from a toner container then being mixed by means of agitating blades provided downstream of the scraper, thus supplying replenished developer for use in development of subsequent images.

With the above-mentioned device, however, movement of the developer with the rotating sleeve produces friction due to contact with a bristle-limiting plate, the scraping plate and agitating roller, etc. which are located close to the peripheral surface of the sleeve, so that the toner is melted by frictional heating, thus adhering to the carrier. This adherence causes fatigue in the developer with resulting premature deterioration in copy quality, and thus it becomes necessary to replace developer frequently.

For retarding the above-described deterioration of the developer, the size of the developer reservoir could be increased so as to have a great amount of developer contained therein. Mere increase in the capacity of the reservoir leads, however, to poor efficiency of developer circulation, i.e., there is an increase in "dead" stock (developer which is not used in actual practice), thus providing only a partial solution to the problem.

In addition, with the aforesaid device, the developr is stirred by means of agitating blades only in the direction at a right angle to the sleeve axis rather than in line with the axis and tends to be biased to one side of the sleeve with respect to the width thereof, so that there arises an uneven distribution of developer over the sleeve. Accordingly, this brings about extremely uneven distribution of toner density over a resulting image.

The present invention is directed to avoiding the aforesaid shortcomings.

SUMMARY OF THE INVENTION

It is a first object of the present invention to provide a magnetic brush developing device which improves the efficiency of circulating the developer, the arrangement thereof being such that there is provided a supply roll having a plurality of buckets on its outer peripheral surface and located below a developer applicator (which will be referred to as the applicator, hereinafter) consisting of a magnet which may form magnetic bristles of developer near its outer periphery, and a nonmagnetic body and the like; and there are provided first and second agitating rolls placed one above the other, a developer scraping plate interposed between the first and second agitating rolls and the outer peripheral surface of the applicator, the second agitating roll being designed to rotate in the direction opposite to that of the supply roll, but in the same direction as that of the applicator, thereby achieving improved circulating efficiency of developer.

It is a second object of the present invention to provide a magnetic brush developing device in which the developer may be agitated also in the rotating direction of a rotary shaft of the applicator by providing a first agitating roll which is split into at least two parts with respect to the axial direction thereof, the foregoing two parts having relatively opposite spiral formations thereon.

It is a third object of the present invention to provide a magnetic brush developing device which may feed a constant amount of developer to the applicator by adjusting the developer-carrying capacity and R.P.M. of a supply roll provided with axial channels on its periphery and located below the applicator. dr

BRIEF DESCRIPTION OF THE DRAWING

Description of the magnetic brush developing device according to the present invention will next be given in conjunction with the accompanying drawing which indicates one embodiment of the invention and in which.

DETAILED DESCRIPTION OF THE INVENTION

Figure 1:
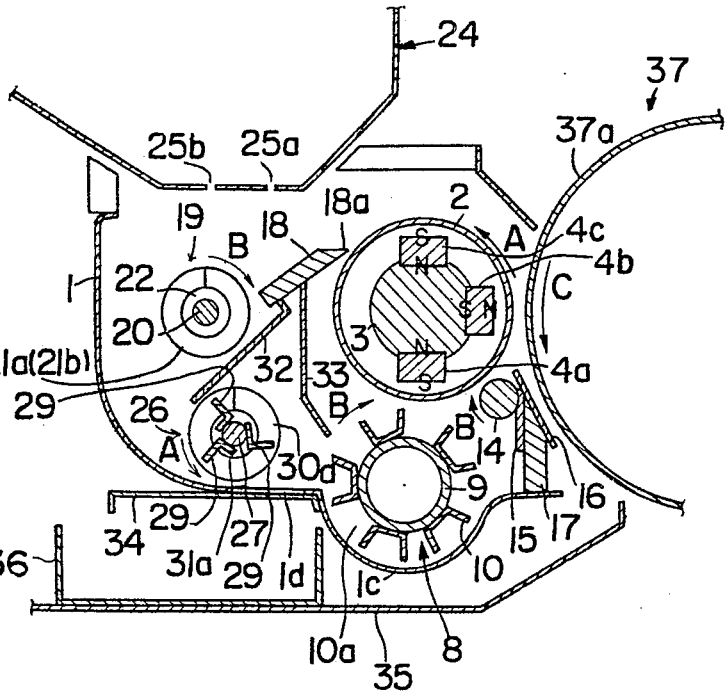
FIG 1. is a cross-sectional side view of the magnetic brush developing device according to the present invention.
Figure 2:
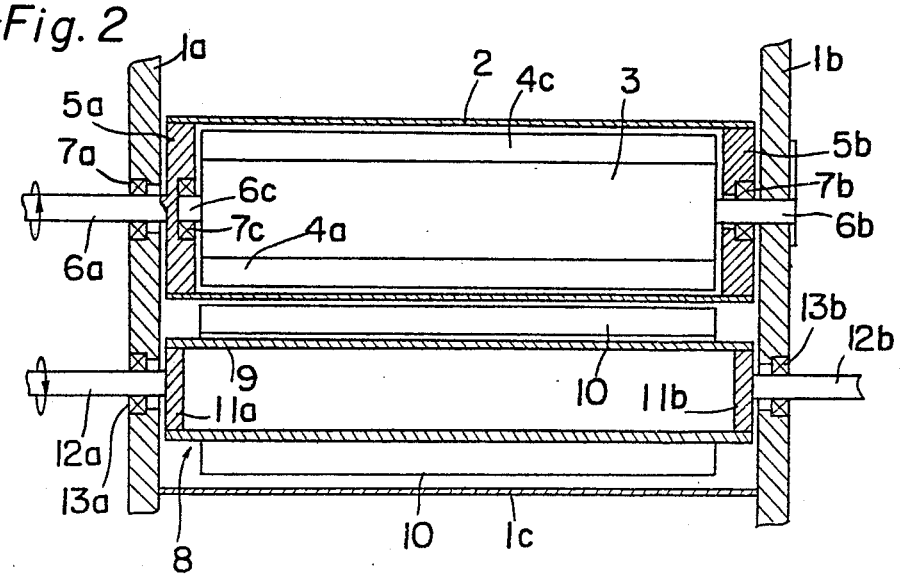
FIGS. 2 and 3 are cross-sectional views showing essential parts of the device of FIG. 1 as viewed from the right in that figure.
Figure 3:
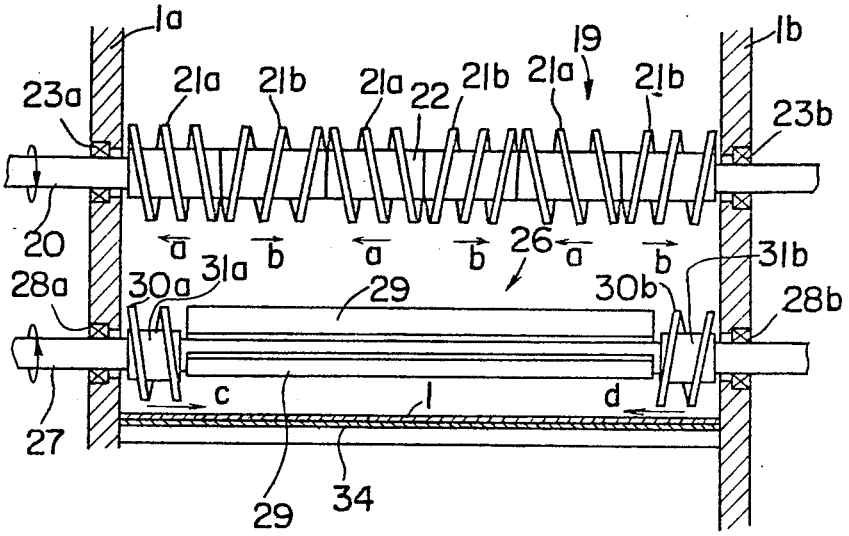

Referring to FIGS. 1 through 3, the magnetic brush developing device according to the invention consists of a sleeve 2 housed in a developer reservoir 1, a supply roll 8, a first agitating roll 19, and a second agitating roll 26. The sleeve 2 is made of a known nonmagnetic material such as aluminum, and is rotatable around fixed magnets **4*a*, 4*b*, 4*c* mounted on a central core 3. The polarities of the magnets on the respective sides thereof which face sleeve 2 are arranged so as to give polarities S,N,S, sequentially. As best shown in FIG. 2, a shaft 6*a* integral with a plate 5*a* at the left end (as viewed in FIG. 2) of sleeve 2 is rotatably supported in a bearing 7*a* in the left sidewall 1*a* of the developer reservoir 1, while a shaft 6*b* integral with the core 3 is affixed in the right sidewall 1*b* of developer reservoir 1. In addition, a plate 5*b* at the right end of sleeve 2 is journaled on shaft 6*b* by means of a bearing 7*b*. On the other hand, a stub shaft 6*c* integral with the core 3 is rotatably supported in plate 5*a* of sleeve 2 by means of a bearing 7*c*. As a result, sleeve 2 is rotated in the arrow direction A (see FIG. 1) by suitably driving shaft 6*a*, while the fixed magnets 4*a*, 4*b*, 4*c*** are stationary at all times.

The supply roll 8 is housed in a concave bottom portion (or "sump") **1*c* of developer reservoir 1 in parallel with sleeve 2, with its cylindrical rotary body 9 mounting members 10 having a U-shaped cross section and extending in parallel with the axis of rotary body 9. In addition, the lengthwise dimension of members 10 is the same as or smaller than the lengthwise dimension of the fixed magnets 4***a*, 4*b*, 4*c* to prevent developer from being spilled off sleeve 2 immediately after the developer has passed a bristle-height limiting roller 14, and to prevent the developer from making ingress into other rotating parts to cause troubles there. Shafts 12*a* and 12*b* (see FIG. 2), rigidly secured in plates 11*a*, 11*b* at respective ends of cylindrical rotary body 9, are rotatably supported in the sidewalls 1*a*, 1*b* of developer reservoir 1 by means of bearings 13*a*, 13*b*. Supply roll 8 is rotated in the arrow direction B by suitably driving shaft 12*a* (or 12*b*), i.e., it is rotated in the direction opposite to that of sleeve 2, so that developer filling the concavities of members 10 as well as the concave spaces 10*a* defined laterally of neighboring members 10, may be transported to the outer periphery of sleeve 2.

For convenience, both the members 10 and the concave spaces 10*a* between them will hereinafter be referred to generally as "buckets" in view of their bucket-like cross-section and function.

Roller 14, which controls the bristle height of the magnetic brush formed on the outer periphery of sleeve 2, is rotatably mounted against a cushion 15 secured (along with a developer-spill preventive plate 16) to a supporting plate 17 provided in developer reservoir 1.

The first agitating roll 19 is located to the left of sleeve 2 as viewed in FIG. 1, with a developer-scraping plate 18 being interposed between the two, the developer-scraping plate 18 having a fixed edge 18*a* located in close proximity to the outer periphery of sleeve 2. In addition, the first agitating roll 19 consists of a shaft 20, at least one righthand spiral agitating blade 21*a*, and one lefthand spiral agitating blade 21*b* (as best seen in FIG. 3). Shaft 20 is rotatably supported in the sidewalls 1*a*, 1*b* of developer reservoir 1 by means of bearings 23*a*, 23*b*, while the agitating blades 21*a*, 21*b* are each rigidly mounted on the outer peripheral surface of a respective collar 22 affixed to shaft 20. By suitably driving shaft 20, roll 19 is rotated (see FIG. 1) in the arrow direction B, i.e., in the direction opposite to the rotating direction of sleeve 2. In addition, toner supply device 24 mounted above developer reservoir 1 has toner supply ports 25*a*, 25*b* with openings directly above developer-scraping plate 18 and roll 19.

The second agitating roll 26 is located below the first agitating roll 19, and includes a shaft 27 rotatably supported (see FIG. 3) in the sidewalls 1*a*, 1*b* by means of bearings 28*a*, 28*b*. Several agitating blades 29 having an L-shaped cross section (FIG. 1) are attached to shaft 27 in parallel with the axial direction thereof. In addition (returning to FIG. 3), a right-hand spiral agitating blade 30*a* and a lefthand spiral agitating blade 30*b* supported on shaft 27 by the medium of collars 31*a*, 31*b* are located at either end of agitating blades 29 close to side-walls 1*a*, 1*b*. By suitably driving shaft 27, roll 26 is rotated in the arrow direction A (see FIG. 1) for smoothly transporting developer from roll 26 to roll 8. With respect to rotation, the aforesaid direction of the second agitating roll 26 is the same as that of sleeve 2. On the other hand, a guide plate 32 is located in an inclined fashion between the first agitating roll 19 and the second agitating roll 26, with the top edge of guide plate 32 abutting the undersurface of the developer-scraping plate 18. The above-mentioned guide plate 32 is supported at a suitable spacing from the wall of reservoir 1 for purposes of smoothly transporting developer from roll 19 to roll 26, the developer being passed through the lefthand side (as viewed in FIG. 1) of roll 26 for better circulation. A vertically-oriented partition wall 33 is located between sleeve 2 and the second agitating roll 26, with the top edge of partition wall 33 abutting the underside of developer-scraping plate 18, while the lower edge of partition wall 33 is bent slightly to the right for preventing direct feeding of developer to sleeve 2 without passing through the supply roll 8, as the developer is forced by roll 26 towards roll 8.

Moreover, in the bottom portion of developer reservoir 1, i.e., below the second agitating roll 26, there is provided an aperture 1*d* normally closed by means of a door 34 which may be opened when desired. Door 34 may be pivoted at its left edge (as viewed in FIG. 1) for opening and closing the aperture 1*d*, or may use clips for that purpose. In addition, a shelf 35 mounting a stock box 36 thereon is located below developer reservoir 1, stock box 36 being removable. As a result, deteriorated developer can be conveyed through aperture 1*d* into stock box 36 upon opening door 34, and stock box 36 then removed to the exterior of the device.

Description of the operation of the developing device according to the present invention will now be given.

With the above-mentioned arrangement, if the shafts 6*a*, 12*a*, 20, 27 are driven, then sleeve 2 and second agitating roll 26 are rotated in the arrow direction A, while supply roll 8 and first agitating roll 19 are rotated in the arrow direction B. The developer forms into so-called magnetic brush bristles which stand upright on the outer peripheral surface of sleeve 2 due to the magnetic field created by the fixed magnets 4*a*, 4*b*, and the magnetic brush bristles slidingly contact the photosensitive surface 37*a* of a drum 37 rotating in the arrow direction C, so that the electrostatic latent image formed on photosensitive surface 37*a* is developed. In the embodiment shown, the magnetic brush bristles formed on the outer peripheral surface of sleeve 2 are limited in their height by means of the bristle-height limiting roller 14. In this respect, roller 14 is rotated in the arrow direction B due to the friction created between it and the magnetic brush by bristle rotating sleeve 2, to limit thereby the height of the bristles so as to moderate the force of the magnetic brush bristles against photosensitive surface 37*a*. Thus, in contrast to the conventional bristle-height limiting plate, the aforesaid roller 14 prevents not only deterioration of developer but also its uneven distribution.

At a position free of the magnetic field (i.e., beyond magnet 4*c*), developer which has completed a developing step is released from the condition causing the upright bristles to be formed, and is then removed from the outer peripheral surface of sleeve 2 by means of scraping plate 18. The developer thus scraped off is moved to the left as viewed in FIG. 1, along the top surface of scraping plate 18, while being mixed with a suitable amount of fresh toner supplied through the ports 25*a*, 25*b* in the toner supply device 24, followed by agitation by means of the first agitating roll 19, which rotates in the arrow direction B. In this case, since the first agitating roll 19 includes righthand spiral agitating blades 21*a* and lefthand spiral agitating blades 21*b*, with both blades 21*a* and 21*b* being provided in an alternate relation in the axial direction of roll 19, the developer moves (see FIG. 3) either in the arrow direction *a* or in the arrow direction *b*, i.e., repeating the waving motions in a direction parallel to the axial direction of sleeve 2 for agitation either in the direction at a right angle to the axial direction of sleeve 2 or in parallel to the axial direction thereof. Unless roll 19 rotates in the arrow direction B, i.e., in the clockwise direction, there results insufficient axial agitation of both the fresh toner and developer which has been removed by means of scraping plate 18, so that such a mixture is transported to the side walls of reservoir 1, presenting uneven density of the developer. Furthermore, in case of continuous reproduction of a document having a solid pattern, the reduction in density of the developer used for developing the solid pattern is evident as compared with that used for the remainder (lines or the like), so that, if another document which does not have a solid pattern is reproduced thereafter, then there results uneven developer density between the part corresponding to the aforesaid solid pattern and the other part. The above-mentioned clockwise rotation of roll 19 may prevent such uneven distribution of developer density.

Uneven distribution of developer density also arises when B4 size is reproduced immediately after repeated reproduction of A4 size, i.e., the part corresponding to A4 size has less density, while the other part has a high density.

The developer thus agitated is introduced through an interstice defined between the first agitating roll 19 and scraping plate 18, being directed by guide plate 32 to the left by of agitating roll 26 as viewed in FIG. 1. There the aforesaid developer is agitated by the second agitating roll 26 which is rotating in the arrow direction A, after which the developer is transported through the interstice defined between the second agitating roll 26 and the bottom portion of the developer reservoir 1. In this respect, there are provided a righthand spiral blade 30*a* and a lefthand spiral blade 30*b* at respective ends outwardly of the agitating blades 29 on the second agitating roll 26. Hence, developer positioned on the opposite sides thereof tends to be biased to the center thereof (in the arrow directions *c*, *d*), thus improving the agitating efficiency. Thereafter, the developer is filled in each bucket 10 and a concave portion 10*a* defined laterally of neighboring buckets 10 of supply roll 8, and then, due to the rotation of supply roll 8 in the arrow direction B, developer is transported to the outer peripheral surface of sleeve 2 for use in subsequent development. As mentioned earlier, the length of the rectangular buckets 10 is the same or less than the length of the fixed magnets 4*a*, 4*b*, 4*c*, so that the developer is transported only to the effective surface on which the magnetic brush bristles are formed on sleeve 2, thus avoiding adhesion of developer to the opposite edges of sleeve 2. Thus, there is no possibility of the developer scattering to the exterior through an interstice between the opposite end surfaces of sleeve 2 and the sidewalls 1*a*, 1*b* of developer reservoir 1. On the other hand, if the effective surface of sleeve 2 is knurled, then scattering of the aforesaid developer may be effectively prevented.

Developer which has deteriorated due to long service may be taken out to the exterior, as previously stated, by conveying same through the opening 1*d* into stock box 36, assuming door 34 has been opened. This provides considerable simplicity in replacing developer as compared with the conventional method, where the entire developing device must be removed from the reproducing apparatus.

The magnetic brush developing device of the invention may be modified, of course, within the scope of the spirit of the invention. For instance, in place of cylindrical sleeve 2, a belt-type sleeve made of nonmagnetic material may be trained around supporting rollers.

As is apparent from the foregoing description of the magnetic brush developing device of the invention, there are provided an applicator, supply roll, first agitating roll, and second agitating roll, whereby the developer is agitated either in the direction at a right angle to the axial direction of the supply body or in the axial direction thereof and then transported, so that even if the size of the developer reservoir is increased so as to contain a larger amount of developer therein, the circulating efficiency of the developer is not impaired to any degree, with resulting reduction in the "dead" , i.e., inactive, stock of developer. Thus, this arrangement retards deterioration of developer, as well as provides readiness for maintenance control. In addition, the first agitating roll is split into at least two portions with respect to the axial direction thereof, which portions carry blades with a relatively opposite spiral, so that the developer may be agitated not only in the direction at a right angle to the axial direction of the applicator, but also in a direction parallel to it, which has not been otherwise attained hitherto. This solves the problem of uneven distribution of developer density in a reproduced image.

Furthermore, a supply roll having toner-carrying buckets is situated below the supply body, so that by varying the R.P.M. of the supply roll and depth of buckets, the capacity of the bucket system may be adjusted to thereby feed a constant amount of developer to the sleeve. The bucket structure itself may, to some extent, be also useful in enhancing the efficiency of developer agitation.

What is claimed is:

1. In an electrophotographic reproducing apparatus including a photosensitive member for receiving and carrying an electrostatic latent image on the surface thereof, a developer housing with a toner supply device and a magnetic brush developing device in which magnetic brush bristles are formed on the outer peripheral surface of the applicator roll, the applicator roll having therein fixed magnetic means and being rotatable in a particular direction so that the magnetic brush bristles slidingly contact the surface of the photosensitive member, thereby developing the latent image and depleting the developer of toner, the improvement comprising:

a first agitating roll located proximate said applicator roll and below said toner supply device and including a plurality of pairs of discrete successive adjoining helical agitating members of alternately opposite orientation on the axis of said first roll for agitating the developer transported from said applicator roll with freshly supplied toner supplied from said toner supply device in the axial direction as well as in a rotational direction of said first agitating roll;

a scraper plate bridging between said applicator roll and said first agitating roll and having one end immediately adjacent said applicator roll for gravity transporting the residual toner to said first agitating roll;

a second agitating roll disposed below said first agitating roll;

a baffle having one end abutting said scraper plate and extending downwardly in close proximity to said first agitating roll and substantially interposed between said first agitating roll and said second agitating roll to prolong the agitating action of said first roll upon the residual toner and freshly supplied toner;

said second agitating roll having a plurality of agitating blades and further having at least two additional agitating members having opposite helical blades thereon located at respective opposite ends of said second roll for directing the flow of developer toward a center of the roll in response to the rotation of said second agitating roll;

a supply roll located below said applicator roll and proximate said second agitating roll and having a plurality of axial channel-shaped buckets on the peripheral surface thereof for transporting the developer to said applicator roll;

a bristle-height limiting roller spaced from said applicator roll and mounted for free rotation in a direction counter to that of said applicator roll, said counter rotation being frictionally induced by forces generated by the contact of said bristles with said bristle-height limiting roller; and means for rotating said first agitating roll and said supply roll in a direction opposite to that of said applicator roll and rotating said second agitating roll in the same direction as that of said applicator roll.

2. An apparatus as defined in claim 1, wherein the housing has a bottom wall, and including a further baffle abutting said scraping blade and interposed between said second roll and said applicator, the further baffle being adapted to direct the output of said second agitating roll to the inlet of the supply roll, said inlet being defined by a space between the end of said further baffle remote from the point of abutment with said scraping blade, and the bottom wall of the developer housing.

3. An apparatus as defined in claim 1, wherein the housing has sidewalls and the direction of rotation of said first agitating roll and the orientation of the helical blades on the agitating members adjacent said sidewalls are such as to direct the mixture toward the sidewalls of the housing.

* * * * *